US007240380B2

(12) United States Patent
Erickson

(10) Patent No.: US 7,240,380 B2
(45) Date of Patent: Jul. 10, 2007

(54) FOOD PREPARATION STATION

(76) Inventor: E. Jay Erickson, 5412 Buffalo Rd., Erie, CO (US) 80516

( * ) Notice: Subject to any disclaimer, the term of this patent is extended or adjusted under 35 U.S.C. 154(b) by 408 days.

(21) Appl. No.: 10/299,621

(22) Filed: Nov. 18, 2002

(65) Prior Publication Data

US 2004/0093667 A1 May 20, 2004

(51) Int. Cl.
*E03C 1/33* (2006.01)

(52) U.S. Cl. ..... 4/631; 4/654

(58) Field of Classification Search ..... 4/619, 4/630–631, 637–638, 654, 656, 659; D23/284, D23/286, 287, 293.1
See application file for complete search history.

(56) References Cited

U.S. PATENT DOCUMENTS

| | | | | |
|---|---|---|---|---|
| D35,008 | S * | 8/1901 | Clow | D23/293.1 |
| 2,175,329 | A | 10/1939 | Watt | |
| D161,596 | S | 1/1951 | Russ | |
| 2,609,024 | A | 9/1952 | Russ | |
| D244,030 | S * | 4/1977 | Tongish | D23/284 |
| 4,229,858 | A | 10/1980 | Baxter et al. | |
| 4,243,184 | A | 1/1981 | Wright | |
| D262,931 | S | 2/1982 | LeVan | |
| 4,462,126 | A * | 7/1984 | Cleaveland | 4/619 |
| 4,765,603 | A | 8/1988 | Huppert | |
| 5,012,537 | A | 5/1991 | Underwood | |
| 5,546,852 | A | 8/1996 | Bidwell | |
| 5,865,105 | A | 2/1999 | Pepelanov | |
| 5,904,271 | A | 5/1999 | Collins et al. | |
| 5,915,851 | A * | 6/1999 | Wattrick et al. | 4/619 |
| 5,934,298 | A | 8/1999 | Singh | |
| 5,996,983 | A | 12/1999 | Laurenzi | |
| 6,276,675 | B1 | 8/2001 | Shamoon | |
| D479,586 | S * | 9/2003 | Piatt | D23/284 |

OTHER PUBLICATIONS

"American Standard Magazine Advertisement", obtained from Good Housekeeping Magazine, Sep. 2002 issue. Good Housekeeping, 959 8th Avenue, New York, New York 10019.

* cited by examiner

*Primary Examiner*—Charles E. Phillips
(74) *Attorney, Agent, or Firm*—Timothy J. Martin; Michael R. Henson; John W. Carpenter

(57) ABSTRACT

A sink assembly that may be supported by a countertop surface or a freestanding cabinet to form a food preparation station is provided. The sink assembly includes a sink basin, a stanchion extending upwardly from the sink basin floor, and a cutting board supported by the stanchion. The stanchion has a sidewall that is formed as a one-piece integral extension of the sink basin floor and terminates in an upper rim portion to support the cutting board. The front wall of the sink basin may have an area of reduced height to facilitate access to the cutting board. The food preparation station may be equipped with an appliance underneath the sink basin, such as a dishwasher, but may also include a garbage disposal, a waste chute, a removable cooking dome, a sloped basin floor, an auxiliary tray sized to partially fit beneath the cutting board, and height adjustment features.

27 Claims, 5 Drawing Sheets

FOOD PREPARATION STATION

FIELD OF THE INVENTION

The present invention generally relates to sinks and sink assemblies such as those commonly found in kitchens. More particularly, the present invention is directed to a sink assembly that may be supported by a countertop or a freestanding cabinet to form a food preparation station. The invention specifically concerns a sink assembly that includes a cutting board to define a food preparation surface associated with the sink.

BACKGROUND

Most residential dwellings and commercial establishments have a room or place equipped for the preparation and cooking of food commonly referred to as a kitchen. Many kitchens provide a sink, cabinets, countertop space and various appliances, such as ovens, stoves, and dishwashers. A commonplace item also found in either a household or a commercial kitchen is a cutting board. Cutting boards typically provide a planar food preparation surface for chopping, slicing, and dicing food products and are useful for transferring the prepared food to a different area of the work place, serving platter, tray, pan, pot, or other cookware. Cutting boards vary in size, style, composition, and even color and are typically placed on a countertop or kitchen appliance to protect the underlying surface and reduce wear on the utensil used to prepare the food.

There are, however, various problems associated with traditional cutting boards that limit their effectiveness and convenience. For example, transferring the prepared food from the cutting board surface to a different area of the work place or to cookware may be hindered because the combined weight of the food and the cutting board is too heavy to lift. Also, transferring food from the cutting board surface may be difficult because the cutting board has become too wet with associated food juices lifting the cutting board would cause the juices to spill onto the floor creating both a mess as well as a hazard. As a result, transferring the prepared food from the cutting board to its destination may involve a time consuming movement of individual pieces.

Another problem associated with traditional cutting boards is the ability to thoroughly cleanse the area surrounding the cutting board after the food has been prepared. Oftentimes, while food is being prepared, waste materials, such as the fat trimmed off meats, will foul the surface of the cutting board. Typically, such waste materials are simply scraped off the cutting board and onto the countertop so as not to interfere with the food preparation. Accordingly, the countertop surface will be littered with discarded food materials requiring that it be cleansed. Thoroughly cleansing the countertop surface may involve the movement of countertop items, which can be time consuming, and may also involve the very difficult task of cleansing crevices in the countertop surface such as may exist between the juncture of the countertop with an appliance such as a stove top.

One solution to the above-mentioned problems is a cutting board designed to straddle a sink basin such as described in U.S. Pat. No. 4,765,603 ("the '603 Patent") to Huppert. The cutting board disclosed therein allows for the simultaneous use of the cutting surface, sink basin, and water faucet. Since the cutting board straddles the sink basin a serving tray or other cookware may be placed beneath the cutting board for the easy transfer of the prepared food. Also, a cutting board of this design allows the convenient disposal of waste material since it may simply be scraped into the sink for drainage to a garbage disposal. Further, sink accessories, such as a faucet and sink sprayer are readily available for cleansing both the sink basin and the cutting board.

A cutting board having a design such as that disclosed the '603 Patent may have various drawbacks. For example, if the cutting board is not properly secured over the sink basin, it may tend to slide shift during the food preparation. Also, the cutting board may obstruct the use of the faucet while suspended over the sink basin such that one may not be able to wash his or her hands until the cutting board is removed. Accordingly, there remains a need for an even better solution to the above problems associated with traditional cutting boards. The present invention is directed to meeting this need.

SUMMARY OF THE INVENTION

It is an object of the present invention to provide a new and useful sink assembly that may be supported by a countertop or mounted in a freestanding cabinet to form a food preparation station;

It is another object of the present invention to provide a food preparation station that incorporates a sink assembly with convenient access to various sink accessories.

It is yet another object of the present invention to provide a food preparation station that incorporates a sink assembly with an easily accessible cutting board for the preparation of food;

A still further object of the present invention is to provide a food preparation station that incorporates a sink assembly that is adjustable in height to accommodate different users;

Still a further object of the present invention is to provide a food preparation station that incorporates a sink assembly having a construction that provides for the convenient transfer of prepared food to a serving tray or other cookware and the disposal of waste materials; and Yet another object of the present invention is to provide a food preparation station that incorporates a sink assembly that is easily cleansed after use.

According to the present invention, then, a sink assembly is provided that may be incorporated with either a counter top or freestanding cabinet to form a food preparation station. The sink assembly component of the food preparation station includes a sink basin, a stanchion, and a cutting board. The sink basin is formed by a front wall portion, a back wall portion, and two end wall portions interposed between the front and back walls that extend upwardly from a sink basin floor to create a sink basin interior. A section of the front wall portion may be of a reduced height relative to the end wall portions to expose an edge of the cutting board and facilitate access thereto.

The sink basin walls may terminate at an upwardly located, outwardly projecting flange where sink accessory items, such as a faucet, soap dispenser, or sink sprayer, may be disposed proximately thereto. In addition, an aperture may be formed through this flange to communicate with a waste receptacle if desired.

The sink basin floor has a drain opening formed therethrough for the drainage of waste materials and may be in fluid communication with a garbage disposal. The sink basin floor may have a sloped floor in the general direction of the drain opening to facilitate the cleansing of sink basin.

The stanchion includes a sidewall extending upwardly from the basin floor as a one-piece integral construction. The stanchion sidewall terminates at an upper rim portion to support the cutting board thereon. The sink basin and the stanchion may be formed of stainless steel, porcelain, or other suitable material.

The cutting board is releasably secured to the stanchion by means of fasteners. The cutting board may be formed of any suitable material, including wood, plastic, ceramic, marble, or a polymethyl methocrylate resin containing a uniformly dispersed alumina trihydrate filler, which is manufactured by E. I. DuPont de Nemours & Co. and sold under the trademark "CORIAN". The cutting board includes a margin that extends beyond the sidewall of the stanchion to define an overhanging lip.

A cabinet supports the sink assembly to form a food preparation station. The cabinet includes a first bay for receiving the sink assembly in a nested relationship. The cabinet may further include a second bay for receiving an appliance such as a dishwasher, garbage compactor, icemaker, or refrigerator. In one possible construction, the cabinet may have a top surface, or countertop, for supporting upper lip of the sink basin sidewalls. Alternatively, the cabinet could be a freestanding unit and include height adjustable legs.

The sink assembly or the food preparation station may also include several other features including an auxiliary tray that can be placed on the sink basin floor. Another feature that may be included is a waste disposal system having an aperture formed in the sink basin. The waste disposal system could further include a waste chute for directing waste materials to a waste receptacle. A third feature that may also be associated with the sink assembly or the food preparation station is a transparent removable dome that may be supported by a portion of either the sink assembly or the countertop of the cabinet supporting the sink assembly.

These and other objects of the present invention will become more readily appreciated and understood from the consideration of the following detailed description of the exemplary embodiments when taken together with the accompanying drawings, in which:

DETAILED DESCRIPTION OF THE EXEMPLARY EMBODIMENTS

The present invention relates to a new and useful sink assembly that may be supported by a countertop surface or a freestanding cabinet to form a food preparation station. The term "food preparation station" should be understood to mean a designated area or place equipped to provide an individual with a convenient location for the preparation of food. As contemplated, the sink assembly component of the food preparation station includes a sink basin, a stanchion extending upwardly from the sink basin floor, and a cutting board supported by the stanchion. The cutting board may be any traditional cutting board that is adapted to be removably secured to the stanchion so as to provide a sturdy, planar surface for the preparation of food. As mentioned, the sink assembly component may be supported by a countertop associated with a row of integrally attached cabinets or may be supported by a freestanding cabinet. It is contemplated that the interior cabinet space beneath the sink assembly may be used to house an appliance such as a refrigerator, garbage compactor, dishwasher, icemaker, or other appliances for the kitchen.

Figure 1:
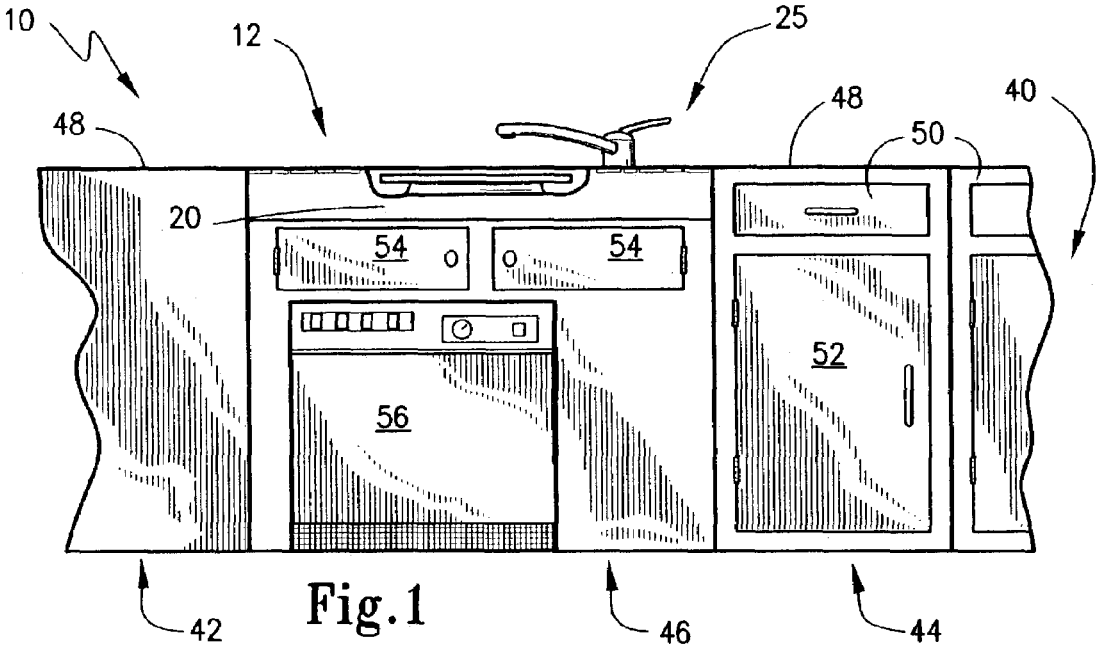
FIG. 1 is a front view in elevation of a sink assembly mounted in a cabinet system to form a food preparation station all according to a first embodiment of the present invention.
Figure 2:
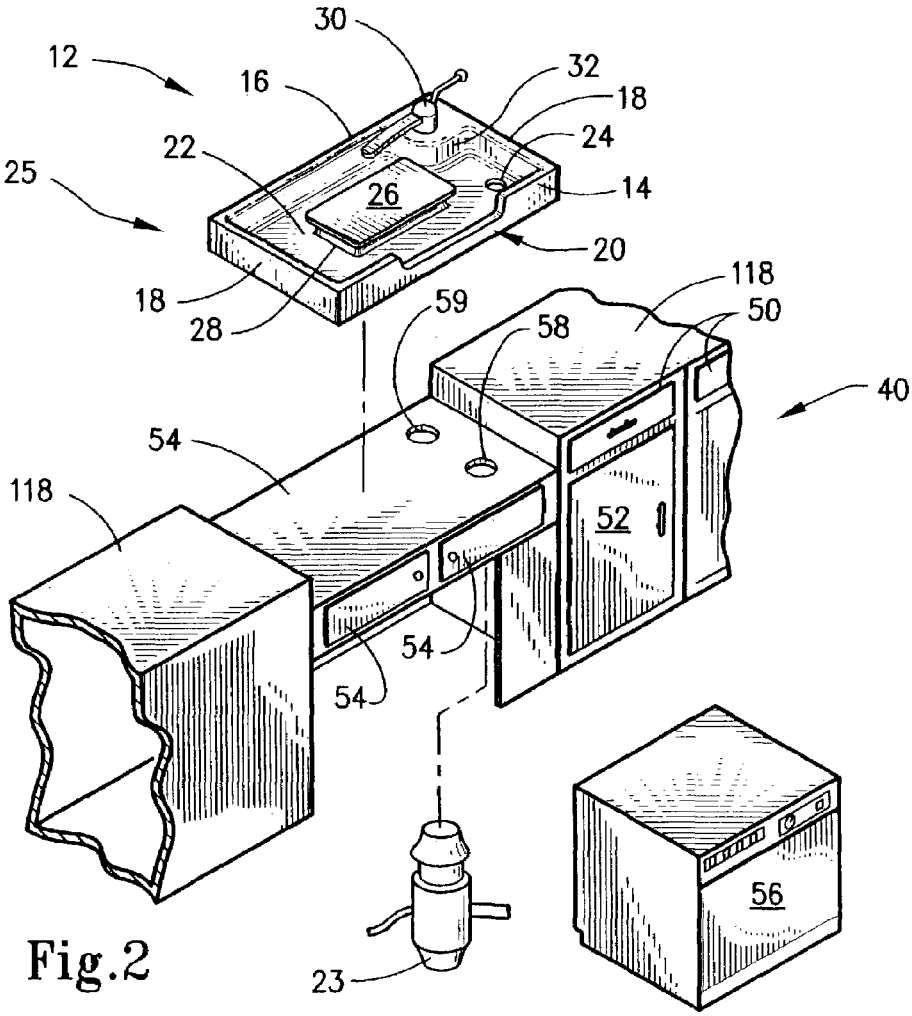
FIG. 2 is an exploded view of the sink assembly and cabinet that combine to form the food preparation station shown in FIG. 1.

To better understand the present invention, reference is first made to FIGS. 1 and 2, which show a first exemplary embodiment of the sink assembly and cabinet. In FIGS. 1 and 2, a food preparation station 10 is formed by sink assembly 12 and cabinet 40. As shown in FIG. 2, sink assembly 12 includes front wall 14, back wall 16, and end walls 18, each of which extend upwardly from basin floor 22 as an integral extension thereof to form sink basin 25. Sink basin 25 may be constructed of a material that is commonly known in the art such as porcelain, stainless steel, and the like, and its dimensions may be suited to fit the needs of either a residential kitchen or a commercial kitchen. Sink basin floor 22 includes drain opening 24 that may be in fluid communication with an arrangement of pipes for carrying off waste water, or, as shown, in fluid communication with a garbage disposal 23.

In addition, as shown in both FIGS. 1 and 2, sink assembly 12 includes faucet 30 and cutting board 26 supported by stanchion 28. The use of the term "stanchion" should be understood to mean an upright pole, post, or support. As such, a stanchion may further include a surrounding sidewall of any selected geometry, including rectangular parallelpided, polyhedral, conical, cylindrical, pyramidal, etc. As will be described in further detail below, stanchion 28 is integrally formed as a one-piece construction with sink basin floor 22 and thus may also be formed of porcelain, stainless steel, or other suitable materials known to the person of ordinary skill in the art.

Cutting board 26 provides a planar cutting surface for the preparation of food and, as contemplated, may be adapted to be removably secured to stanchion 28 Cutting board 26 may be constructed of any suitable material for the preparation of food such as wood, plastic, marble, or a polymethyl methocrylate resin containing a uniformly dispersed alumina trihydrate filler, which is manufactured by E. I. DuPont de Nemours & Co. and sold under the trademark "CORIAN". As shown, a portion of front wall 14 has a reduced height so as to form a gap 20 thereby to expose an edge of cutting board 26.

Also, as is shown in FIGS. 1 and 2, sink assembly 12 may further include a faucet 30. In this particular embodiment, faucet 30 is mounted on platform 32, which is located in the interior of sink basin 25. As should be understood, the present invention is not limited to the design of faucet 30 shown here, but contemplates any of a variety of sink faucet designs that are common in the marketplace. Accordingly, the present invention is not limited to the faucet design represented in this figure or shown in the other figures referenced in this description.

With continued reference to FIGS. 1 and 2, cabinet 40 supports sink assembly 12. For discussion purposes, cabinet 40 may be visually divided into three (3) sections; left section 42, right section 44, and center section 46. Left section 42 and right section 44 each have a top surface 48 in the form of a countertop. Right section 44 further includes drawers 50 and cabinet doors 52. The interior space of drawers 50 and cabinet doors 52 may be used as storage area for food preparation items or any items capable of fitting into their interior space. Center section 46, on the other hand, includes dishwasher 56. As should be understood, center section 46 is not limited to a construction that includes dishwasher 56, but rather may also include drawers and cabinet doors. Alternatively, interior space of center portion 46 may also be used to house other appliances such as garbage compactor, a refrigerator unit, an icemaker or other appliance capable of fitting within the available interior space. In addition, center section 46 includes access panels 54. While not in association with drawers, access panels 54 provide access into the interior of center section 46 so that the plumbing or the sink assembly may be serviced for repairs or routine maintenance. As will be discussed in further detail below, access panels 54 provide access to the structure that fastens the cutting board to the stanchion.

As best shown in FIG. 2, sink assembly 12 is adapted to be set upon platform 54 of center section 46. Platform 54 includes apertures 58 and 59 that align respectively with drain opening 24 and faucet 30 to allow for the appropriate plumbing may be connected thereto.

As stated above, sink basin 25 may be constructed to suit the needs of either a residential kitchen or a commercial kitchen. As contemplated, then, the basin of the sink assembly could extend beyond the length and depth of an average residential sink basin for either residential or commercial purposes. For example, sink basin 25 shown in FIG. 1 could extend the length of the countertop 48. A sink basin of sufficient dimensions could accommodate a plurality of spaced apart stanchions and cutting boards mounted thereon such that more than one person may work at the food preparation station at one time. Alternatively, the food preparation station could be in the form of a center island.

Figure 3:
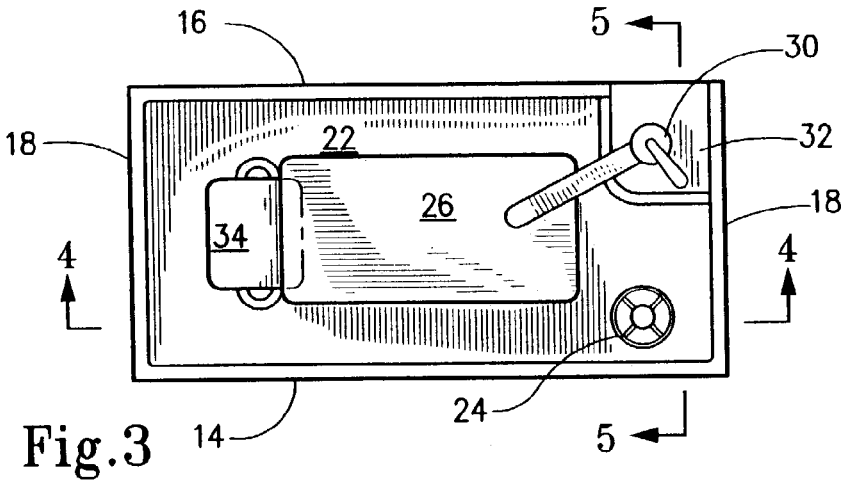
FIG. 3 is a top plan view of the sink assembly shown in FIGS. 1 and 2 with a tray in a food transfer position.

Turning now to FIG. 3, sink assembly 12 of FIGS. 1 and 2 is shown to include auxiliary tray 34. Auxiliary tray 34 is positioned upon sink basin floor 22 in the food transfer position. Auxiliary tray 34 may be any type of receiving tray, plate, bowl, cookware, etc. for receiving prepared food that is scraped off of cutting board 26. As shown, an outward margin of cutting board 26 overhangs auxiliary tray 34 to facilitate the transfer of the prepared food to the tray. Auxiliary tray 34 and the prepared food may then be transferred to the desired location.

Figure 4:
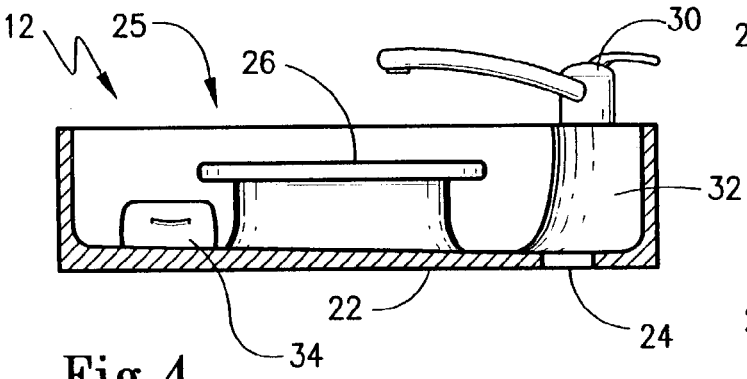
FIG. 4 is a cross sectional view of the sink assembly shown in FIG. 3 taken about lines 4-4.
Figure 5:
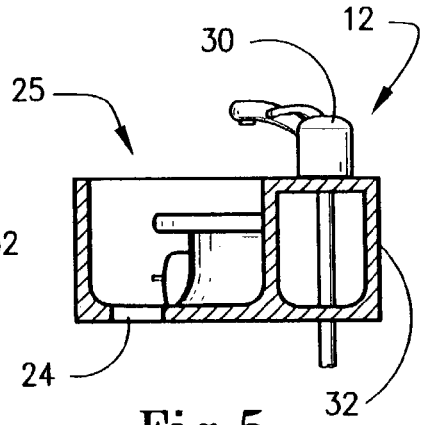
FIG. 5 is a cross sectional view of the sink assembly shown in FIG. 3 taken about the lines 5-5.

With reference now to FIGS. 4 and 5, sink basin floor 22 may be constructed to slope at an angle with respect to its horizontal support surface. Specifically, as shown in FIG. 4, sink basin floor 22 slopes downwardly from serving tray 34 to drain opening 24. In addition, as shown in FIG. 5, sink basin floor may also slope in a second direction, for example, downwardly from platform 32 to drain opening 24. The slope of sink basin floor 22 facilitates the cleansing of sink basin 25 by directing water, and thus waste material, to the general direction of drain opening 24. It should be understood by one ordinarily skilled in the art that sink basin floor 22 does not have to have a sloped floor. Further, it should be understood that sink basin floor 22 does not need to be sloped in two directions as described with reference to FIGS. 4 and 5.

Figure 6:
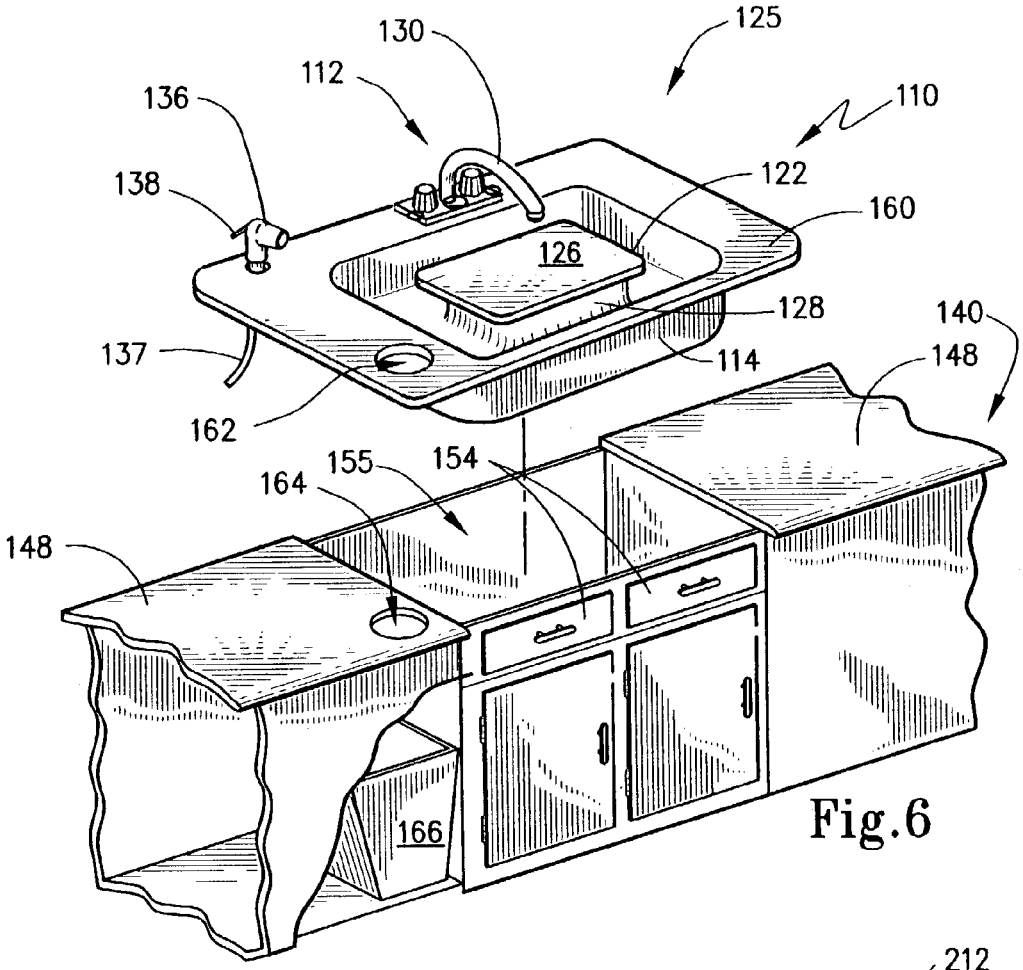
FIG. 6 is an exploded view of a sink assembly and a cabinet, partially broken away, that combine to form a food preparation station all according to a second embodiment of the present invention.

A second exemplary embodiment of a food preparation station according to the present invention is shown in FIG. 6. In this second embodiment, sink assembly 112 and cabinet 140 combine to form food preparation station 110. Sink assembly 112 includes sink basin 125, which is similar to sink basin 25 of FIGS. 1-5 in that it is formed of front wall 114, back wall (not shown) and end walls (not shown) that extend upwardly from sink basin floor 122 as an integral one-piece construction. Sink basin 125 also includes an outwardly projecting flange 160 that is adapted to be supported by countertop 148 of cabinet 140. Located about flange 160 are several sink accessory items, namely, faucet 130, sink spray 136, and aperture 162. Sink sprayer 136 is a common kitchen sink accessory that is associated with hose 137 and trigger 138. Sink sprayer 136 may be pulled from its stationary position and used by depressing trigger 138 to cleanse the interior of sink basin 125 and wash waste materials toward the drain opening (not shown).

Sink assembly 112 also includes aperture 162 formed through flange 160. A corresponding aperture 164 is formed through countertop 148 of cabinet 140 and is in communication with waste receptacle 166. Cabinet 140 includes bay 155 that is sized and adapted to receive sink basin 112. When sink assembly 112 is disposed in bay 155 and supported by countertop 148, apertures 162 and 164 uniformly align with one another so that waste materials can be deposited directly into waste receptacle 166. The use of apertures 162 and 164 avoids the need of having to transfer the waste materials to a waste receptacle that is removed from the food preparation station thus providing a more convenient work place Cabinet 140 further includes access panels 154 and cabinet doors 152. Cabinet doors 152 provide an entryway into the interior of cabinet 140 for the storage of items, but also to provide access to the plumbing and sink assembly 112.

Figure 7:
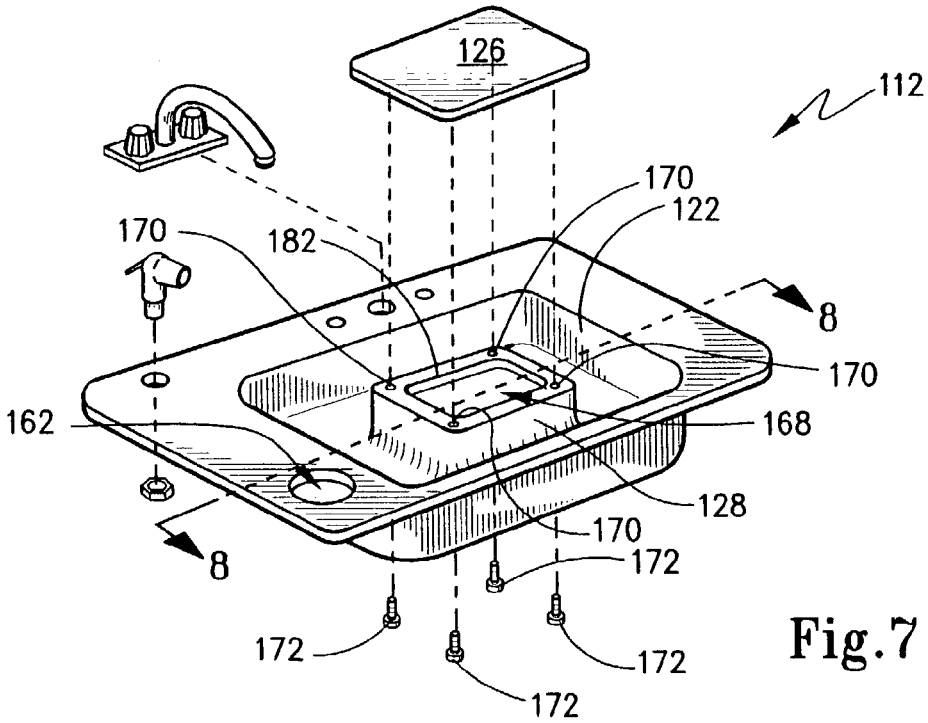
FIG. 7 is an exploded view of the sink assembly shown in FIG. 6.

As mentioned above with respect to FIGS. 1-6, and as contemplated by the present invention, the sink assembly component of the food preparation includes a cutting board supported by a stanchion located within the interior of the sink basin. Both the stanchion and the mechanism by which the cutting board is secured to the stanchion are discussed in greater detail with respect to FIGS. 7-9. FIG. 7 shows an exploded view of the sink assembly component of food preparation station 110 shown in FIG. 6. As shown, stanchion 128 stanchion extends upwardly from sink basin floor 122 as an integral one piece construction to create an interior space 168. Stanchion 128 may be formed as die cut, stamped-out piece formed through sink basin floor 122. The top surface 182 of stanchion 128 provides a seat for cutting board 126. Further, top surface 182 includes an outward margin that overhangs interior space 168 to accommodate apertures 170, which are used for the securement of cutting board 126 by threaded screws 172. The overhanging margin of top surface 182 is best shown in FIGS. 8-10 discussed below.

Figure 8:
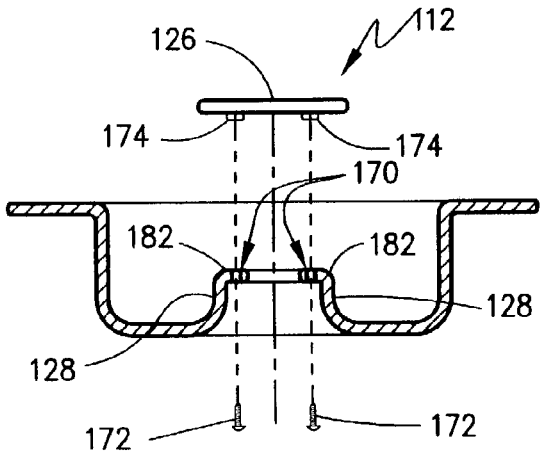
FIG. 8 is a cross-sectional view of the sink assembly shown in FIG. 7 taken about lines 8-8 that shows one possible structure for fastening the cutting board to the stanchion sidewall.

As shown in FIG. 8, apertures 170 are formed through the overhanging margin of top surface 182 so that threaded screws 172 may pass through apertures 170 and be received by plates 174 mounted on cutting board 126. Screws 172 are tightened into plates 174 for securement of cutting board 126 to stanchion 128. It should be understood that apertures 170, which are shown in FIG. 7 to be located at the corners of the stanchion sidewalls, are not limited to this location, but may be placed at any location that would provide adequate securement of the cutting board. The present invention contemplates that the fasteners be removable so that cutting board 126 may be released from securement to be cleansed.

Figure 9:
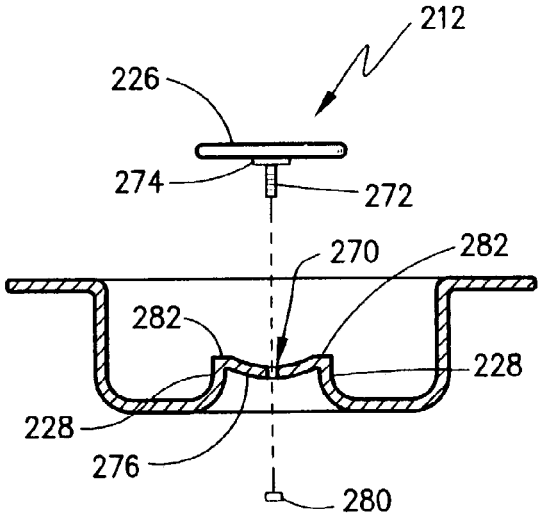
FIG. 9 is a cross-sectional view of a sink assembly showing another structure by which the cutting board may be fastened to the stanchion sidewall.

An alternative structure for securing a cutting board to the stanchion is shown in FIG. 9. Here again, stanchion 228 includes upwardly extending sidewalls that are integrally formed from sink basin floor 222. Stanchion 228 terminates has a top surface 282 to provide a seat for cutting board 226. Stanchion 228 also includes bridge portion 276 interposed between the stanchion sidewalls with aperture 270 formed therethrough. Aperture 270 is operative to receive a fastener for the securement of cutting board 226. In this particular embodiment, the cutting board fastener is in the form of a centrally located screw 272 that is secured to cutting board 226. Aperture 270 is adapted to receive cutting board screw 272 when cutting board 226 is seated on top surface 282. Nut 280 may then be used to secure cutting board 226 in place.

Figure 10:
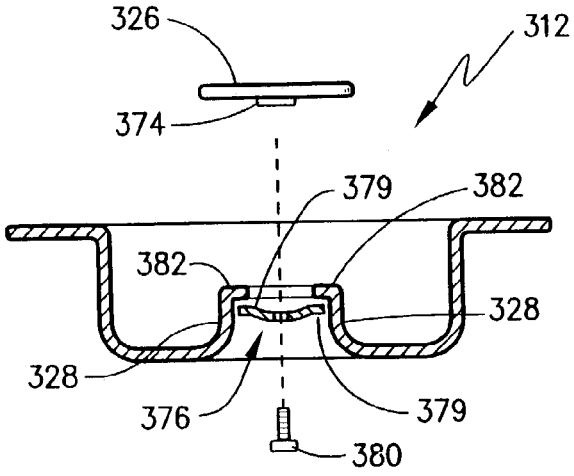
FIG. 10 is a cross-sectional view of a sink assembly showing yet another structure by which the cutting board may be fastened to the stanchion sidewall.
Figure 11:
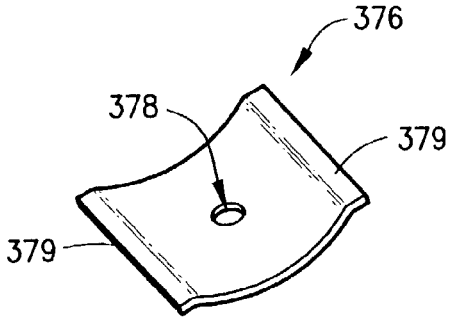
FIG. 11 is perspective view of the anchor plate component of the mounting structure shown in FIG. 10.

FIG. 10 shows yet another structure by which the cutting board may be mounted to the stanchion. Here again, stanchion 328 includes upwardly extending sidewalls that are integrally formed from sink basin floor 322 to terminate at a top surface 382 to provide a seat for cutting board 326. Here, an anchor plate 376 is provided as a separate piece apart from stanchion 328 and is perhaps best shown in FIG. 11. Anchor plate 376 may be a U-shaped piece with aperture 378 formed therethrough for receiving bolt 380. Further, as shown, anchor plate 376 includes flared ends that form flanges 379 that extend to abut the overhanging margin of the stanchion's top surface 382. As bolt 380 is tightened into plate 374 of cutting board 326, anchor plate 376 will bend slightly to tightly secure the cutting board 326 to the stanchion. As should be understood by a person of ordinary skill in the art, anchor plate 376 could also be a rectangular piece.

Figure 12:
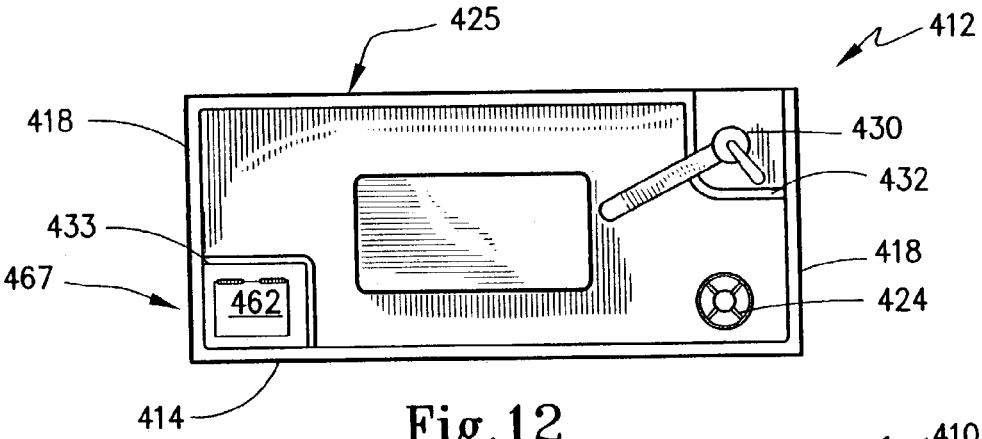
FIG. 12 is a top plan view of a sink assembly according to a third embodiment of the present invention.
Figure 13:
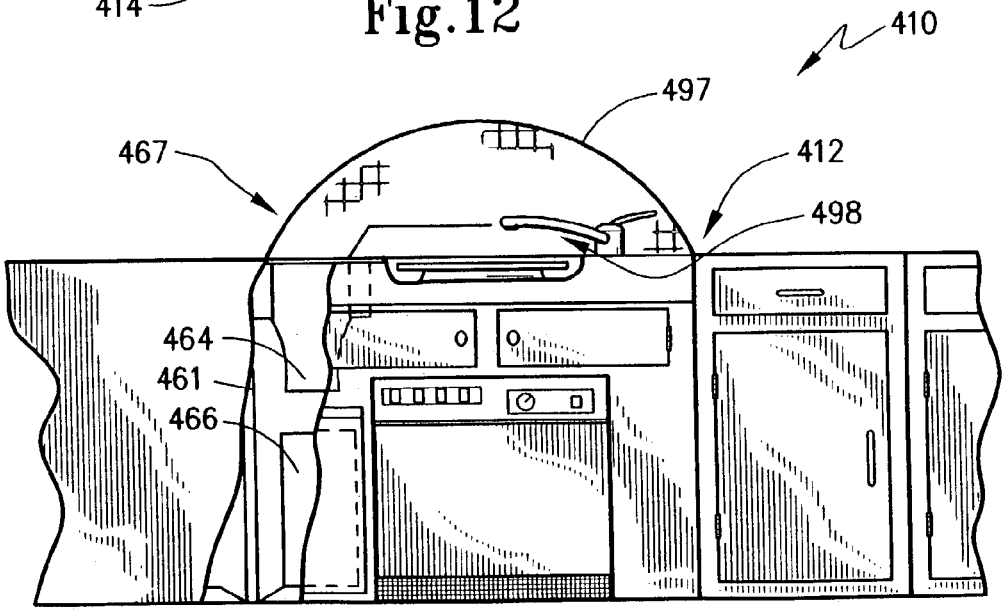
FIG. 13 is a front view in elevation of the sink assembly shown in FIG. 12 mounted in a cabinet system, partially broken away, to form a food preparation station all according to a third embodiment of the present invention.

A third exemplary embodiment of a sink assembly according to the present invention is shown in FIG. 12. Similar to the sink assembly shown and discussed with reference to FIGS. 1-3 above, sink assembly 412 includes sink basin 425 and an in-sink faucet 430 mounted on platform 432. As shown, however, sink assembly 412 further includes a second platform 433, the height of which is preferably the same as the height of the juncture of end wall 418 and front wall 414. Second platform 433 includes pivoting door 462 that conceals an aperture formed through the sink basin floor. As shown in FIG. 13, platform 432 and door 462 are associated with a chute 464 that is spaced above waste receptacle 466. Altogether, these components combine to form waste disposal system 467.

Waste disposal system 467 provides a structure by which waste materials that are not suitable for disposal via drain opening 424 may be discarded. Placing platform 433 within the sink basin interior provides an alternative construction to the communicating apertures 162 and 164 described above with reference to FIGS. 6 and 7. As such, it offers the similar convenience of discarding waste materials in a waste receptacle without having to transfer such materials to a receptacle that is remote to the food preparation area.

With continued reference to FIGS. 12 and 13, platform 433 may be formed as an integral extension of the basin floor such as described above with reference to the construction of the stanchion. In one construction, door 462 could be biased in the closed position, which is shown in FIG. 12. To discard waste materials, the user could push the door downwardly to gain access to the waste aperture and chute 464. Alternatively, door 462 could be pulled upwardly or not even be included as a component of this waste disposal system. If included, door 462 could be formed of any suitable material such as stainless steel or be formed as a plastic covering, or by other materials that would be understood by a person ordinarily skilled in the art.

Waste receptacle 466 is located behind cabinet door 461 and may be disposed on the floor of the cabinet interior. Alternatively, waste receptacle 466 could be associated with a pull-out cabinet door system whereby the waste receptacle automatically rolls out when the cabinet door is opened. Other structures, which are commonly known in the art, are also contemplated.

With continued reference to FIG. 13, removable transparent dome 497 may be placed over sink assembly 412. Gap 498, in dome 497, provides access to the cutting board 426 so that food may be prepared beneath dome 497. Dome 497 acts as a splashguard to keep the area surrounding food preparation station 410 clean. For example, tenderizing meats oftentimes causes associated juices to splatter about the food preparation area. The use of dome 497 would contain the splattered juices and minimize the cleansing of the food preparation area. Dome 497 is preferably made of a light weight, transparent material such as plastic, or other resinous material which may be used as a glass substitute such as that sold by Rohm & Haas Company Corporation under the trademark "PLEXIGLAS".

Figure 14:
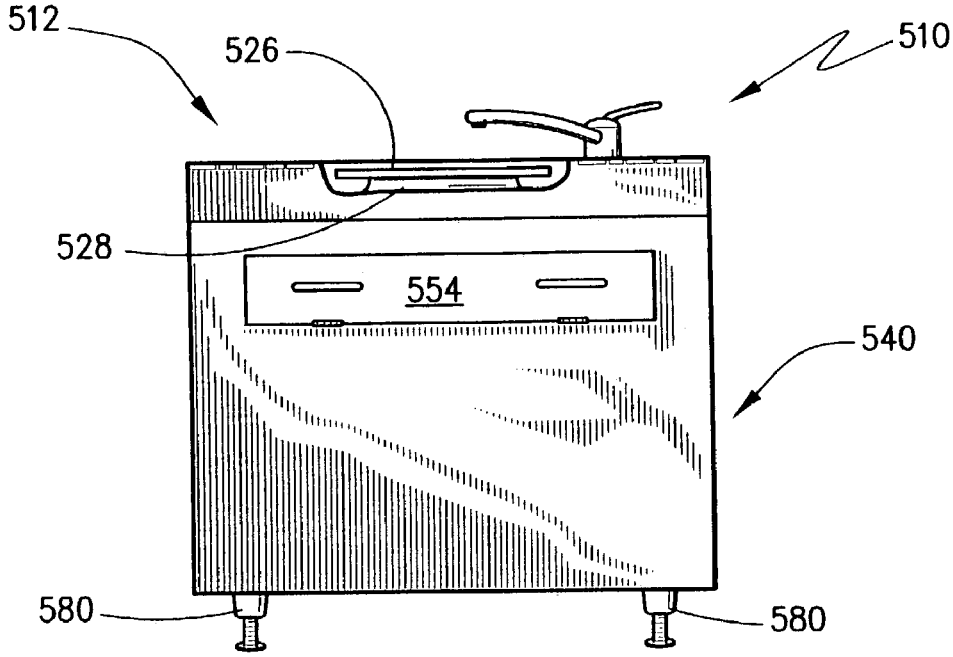
FIG. 14 is front view in elevation of a sink assembly mounted in a freestanding cabinet to form a food preparation station all according to a third embodiment of the present invention.

FIG. 14 shows a food preparation station 510 according to a third embodiment. Here, food preparation station 510 is formed by sink assembly 512 supported by freestanding cabinet 540. Cabinet 540 includes access panel 554, which provides access into the interior of cabinet 540 so that if desired, cutting board 526 may be removed from stanchion 528. Cabinet 540 further includes legs 580. As contemplated, legs 580 may include means to adjust the height of the cabinet 540. For example, as shown, legs 580 are threaded such that they may be turned either clockwise or counterclockwise to vary the height of the cabinet. The ability to adjust the height of cabinet 540 accommodates the height of different users of food preparation station 510 to maximize comfort while preparing food.

Figure 15:
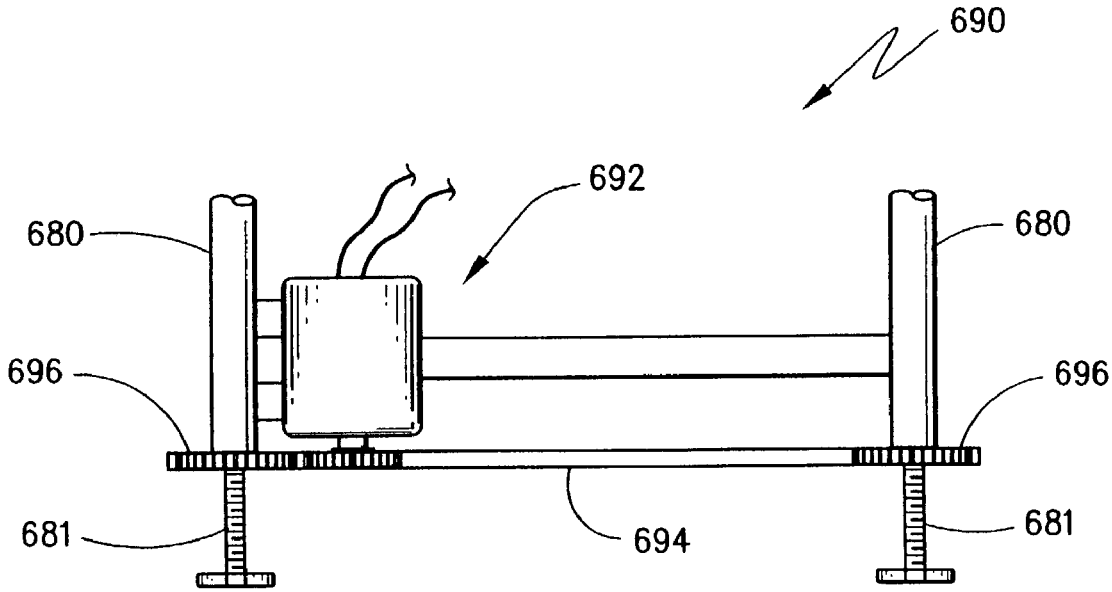
FIG. 15 is a front view in elevation of a motorized mechanism for adjusting the height of the legs of the freestanding cabinet shown in FIG. 14.

An alternative means for adjusting the height of the legs of a freestanding cabinet is shown in FIG. 15. As shown, mechanized system 690 includes motor 692 that may be mounted within the cabinet to drive chain 694. Chain 694 is engaged by sprockets 696, which are mounted on legs 680.

As motor 692 drives chain 694, leg extensions 681, which are housed in legs 680, may either be extended to increase the height of the cabinet, or retracted to decrease the cabinet height.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A sink assembly adapted to be supported in a generally horizontal plane by a horizontal support surface comprising:

(A) a sink basin including a basin floor with a drain opening formed therethrough and a stanchion including a sidewall extending upwardly from said basin floor as a one piece integral extension thereof and surrounding an interior space to terminate at an upper rim portion adapted to support a cutting board thereon;

(B) a cutting board sized and adapted to be supported by said stanchion and including a margin that extends beyond said sidewall of said stanchion to define an overhanging lip; and (C) an auxiliary tray that is adapted to be selectively placed on and supported by said basin floor to define a transfer state wherein said overhanging lip of said cutting board extends over at least a portion of said auxiliary tray when said auxiliary tray is in the transfer state.

2. A sink assembly according to claim 1 including a cabinet having a bay formed therein, said sink basin adapted to be disposed in the bay.

3. A sink assembly according to claim 2 wherein said cabinet includes at least one appliance received therein, said appliance selected from a group consisting of dishwashers, garbage compactors, icemakers, and refrigerators.

4. A sink assembly according to claim 2 wherein said cabinet is freestanding.

5. A sink assembly according to claim 4 wherein said cabinet includes height adjustable legs.

6. A sink assembly according to claim 1 including a garbage disposal in fluid communication with the drain opening.

7. A sink assembly according to claim 1 including a waste aperture formed in said sink basin.

8. A sink assembly according to claim 7 wherein the waste aperture is formed in said sink basin floor.

9. A sink assembly according to claim 8 including a waste chute in communication with said waste aperture.

10. A sink assembly according to claim 1 including a removable dome, a portion of which is adapted to be supported by said sink assembly.

11. A sink assembly according to claim 1 wherein said basin floor slopes downward toward the drain opening relative to said horizontal support surface.

12. A sink assembly according to claim 1 wherein said sink basin includes a basin sidewall extending upwardly from said basin floor as a one-piece integral extension thereof to create a basin interior, said basin sidewall terminating at an upwardly located, outwardly projecting flange.

13. A sink assembly according to claim 12 wherein said flange has an aperture formed therethrough.

14. A sink assembly according to claim 12 wherein said sink basin includes at least one sink accessory item disposed proximately to said flange, said sink accessory item selected from a group consisting of faucets, soap dispensers, and sink sprayers.

15. A sink assembly according to claim 1 wherein said sink basin includes a front wall portion, a back wall portion spaced apart from said front wall portion, and two end wall portions interposed between said front wall portion and said back wall portion wherein said front wall portion has a section of reduced height relative to said end wall portions.

16. A sink assembly according to claim 1 wherein said cutting board is formed of a material selected from a group consisting of wood, plastic, ceramic, marble, and a polymethyl methocrylate resin containing a uniformly dispersed alumina trihydrate filler.

17. A sink assembly according to claim 1 wherein said basin and said stanchion are formed of a material selected from a group consisting of stainless steel and porcelain.

18. A food preparation station adapted to be supported in a generally horizontal plane by a horizontal support surface comprising:

(A) a sink basin including (1) a basin floor with a drain opening formed therethrough wherein said basin floor slopes downward toward the drain opening relative to the horizontal support surface;

(2) a stanchion; and (3) a basin sidewall extending upwardly from said basin floor as a one piece integral extension thereof to create a sink basin interior;

(B) a cutting board supported by said stanchion and including a margin that extends beyond said sidewall of said stanchion to define an overhanging lip;

(C) an auxiliary tray that is adapted to be selectively placed on and supported by said basin floor to define a transfer state wherein said overhanging lip of said cutting board extends over at least a portion of said auxiliary tray when said auxiliary tray is in the transfer state; and (D) a cabinet including a bay for receiving said sink basin in a nested relationship, said cabinet further including an interior cabinet space located beneath said sink basin when disposed in the bay.

19. A food preparation station according to claim 18 wherein said basin sidewall terminates at an upwardly located, outwardly projecting flange.

20. A food preparation station according to claim 19 wherein said cabinet includes a top surface adapted to support said flange of said sink basin sidewall.

21. A food preparation station according to claim 18 wherein said cabinet includes at least one appliance disposed in the interior cabinet space, said appliance selected from a group consisting of dishwashers, garbage compactors, icemakers, and refrigerators.

22. A food preparation station according to claim 18 wherein said cabinet is freestanding.

23. A food preparation station according to claim 22 wherein said cabinet includes height adjustable legs.

24. A food preparation station according to claim 18 wherein said basin sidewall includes a first portion having a first height and a second portion having a second height that is less than said first portion, said second portion adapted to facilitate access to said cutting board.

25. A food preparation station according to claim 18 including a waste disposal system wherein said waste disposal system includes a waste aperture formed in said sink basin.

26. A food preparation station according to claim 18 including a removable dome, a portion of which is adapted to be supported by said cabinet.

27. A sink assembly adapted to be supported in a generally horizontal plane by a horizontal support surface comprising:

(A) a sink basin including (1) a basin floor with a drain opening formed therethrough;

(2) a basin sidewall extending upwardly from said basin floor as a one-piece integral extension thereof to create a basin interior, including a. a back wall having a top surface b. a front wall spaced apart from said back wall and having a section of reduced height relative to said top surface of said back wall, said section having an upper edge; and c. two end walls interposed between said front wall and said back wall;

(3) a stanchion including a sidewall extending upwardly from said basin floor as a one piece integral extension thereof and surrounding an interior space to terminate at an upper rim portion adapted to support a cutting board thereon; and (B) a cutting board sized and adapted to be supported by said stanchion, said cutting board having a cutting surface that is formed in a plane that is positioned below said top surface and above said upper edge in generally parallel relation thereto.

* * * * *